US010247130B2

(12) United States Patent
Vieira De Morais et al.

(10) Patent No.: US 10,247,130 B2
(45) Date of Patent: Apr. 2, 2019

(54) WET CYLINDER LINER FOR INTERNAL COMBUSTION ENGINES, PROCESS FOR OBTAINING A WET CYLINDER LINER, AND INTERNAL COMBUSTION ENGINE

(71) Applicants: Mahle Metal Leve S/A, Jundiaí (BR); Mahle International GmbH, Stuttgart (DE)

(72) Inventors: Paulo Roberto Vieira De Morais, São Bernardo do Campo (BR); Gisela Ablas Marques, Jundiaí (BR)

(73) Assignees: Mahle Metal Leve S/A (BR); Mahle International GmbH (DE)

( * ) Notice: Subject to any disclaimer, the term of this patent is extended or adjusted under 35 U.S.C. 154(b) by 0 days.

(21) Appl. No.: 15/519,146

(22) PCT Filed: Oct. 16, 2015

(86) PCT No.: PCT/EP2015/073960
§ 371 (c)(1),
(2) Date: Apr. 13, 2017

(87) PCT Pub. No.: WO2016/059194
PCT Pub. Date: Apr. 21, 2016

(65) Prior Publication Data

US 2017/0234262 A1 Aug. 17, 2017

(30) Foreign Application Priority Data

Oct. 16, 2014 (BR) ..... 10 2014 025812 4

(51) Int. Cl.
*F02F 1/16* (2006.01)
*F02F 1/12* (2006.01)
(Continued)

(52) U.S. Cl.
CPC ..... *F02F 1/16* (2013.01); *B05D 1/12* (2013.01); *B05D 3/002* (2013.01); *B05D 3/0254* (2013.01);
(Continued)

(58) Field of Classification Search
None
See application file for complete search history.

(56) References Cited

U.S. PATENT DOCUMENTS 4,495,907 A * 1/1985 Kamo ..... C23C 18/1216 123/193.2
6,418,889 B1 * 7/2002 Manabe ..... B22C 9/10 123/41.74
(Continued)

FOREIGN PATENT DOCUMENTS

CN 1760525 A 4/2006
CN 102330612 A 1/2012
(Continued)

OTHER PUBLICATIONS

English abstract for KR-20070060326.
(Continued)

*Primary Examiner* — Hung Q Nguyen
*Assistant Examiner* — Brian P Monahon
(74) *Attorney, Agent, or Firm* — Fishman Stewart PLLC

(57) ABSTRACT

A wet cylinder liner for internal combustion engines may include a cylindrical body composed of a ferrous alloy having a circumferential outer surface. The cylindrical body may include a first layer and a second layer disposed sequentially on the outer surface. The first layer may include at least one of at least one silicon and at least one two-component epoxy adhesive. The second layer may include a silane-elastomer compound. The silane-elastomer compound may include nanoparticles of silicon oxide and an
(Continued)

adhesion modifier additive. The second layer may be configured as an interface between a cooling fluid and the first layer, as well as to resist erosion by cavitation. The first layer may facilitate an interface for resistance at high temperatures.

20 Claims, 2 Drawing Sheets

(51) Int. Cl.

| | |
|---|---|
| ***B05D 1/12*** | (2006.01) |
| ***B05D 3/02*** | (2006.01) |
| ***B05D 7/14*** | (2006.01) |
| ***B05D 7/00*** | (2006.01) |
| ***B22D 15/02*** | (2006.01) |
| ***B05D 3/00*** | (2006.01) |

(52) U.S. Cl.
CPC ..... *B05D 7/146* (2013.01); *B05D 7/582* (2013.01); *B05D 7/584* (2013.01); *B22D 15/02* (2013.01); *F02F 1/12* (2013.01); *F02F 2200/06* (2013.01)

(56) References Cited

U.S. PATENT DOCUMENTS

| | | | | |
|---|---|---|---|---|
| 8,813,734 | B2 * | 8/2014 | Kadoshima | F02B 77/11 123/193.1 |
| 2001/0037786 | A1 * | 11/2001 | Fischer | B22D 15/02 123/193.2 |
| 2005/0235944 | A1 * | 10/2005 | Michioka | C23C 4/02 123/193.2 |
| 2008/0053396 | A1 * | 3/2008 | Hiraishi | F16J 9/00 123/193.2 |
| 2010/0178491 | A1 | 7/2010 | Mennig et al. | |
| 2012/0318228 | A1 * | 12/2012 | Aharonov | C23C 16/509 123/193.2 |
| 2013/0255651 | A1 * | 10/2013 | Nomura | F02B 23/00 123/668 |
| 2014/0102401 | A1 | 4/2014 | Issler | |
| 2015/0118396 | A1 * | 4/2015 | Wakayama | C09D 5/00 427/258 |
| 2015/0136062 | A1 * | 5/2015 | Tsuji | F16J 9/26 123/193.4 |
| 2015/0204233 | A1 * | 7/2015 | Nanba | F02F 1/18 123/668 |

FOREIGN PATENT DOCUMENTS

| | | | |
|---|---|---|---|
| DE | 102007029668 | A1 | 1/2009 |
| GB | 2041492 | A | 9/1980 |
| JP | S54-52510 | U | 4/1979 |
| JP | S58-1751 | U | 1/1983 |
| JP | 59162342 | A | 9/1984 |
| JP | S62-8345 | U | 1/1987 |
| JP | 2008-513647 | A | 5/2008 |
| KR | 20070060326 | A | 6/2007 |
| KR | 1020070060326 | A | 6/2007 |
| WO | WO-2012/159606 | A1 | 11/2012 |

OTHER PUBLICATIONS

Japanese Notice of Allowance dated Aug. 22, 2017 related to corresponding Japanese Patent Application No. 2017-518120.
Chinese Office Action dated Nov. 17, 2017 related to corresponding Chinese Patent Application No. 2017111401962490.

* cited by examiner

WET CYLINDER LINER FOR INTERNAL COMBUSTION ENGINES, PROCESS FOR OBTAINING A WET CYLINDER LINER, AND INTERNAL COMBUSTION ENGINE

CROSS-REFERENCE TO RELATED APPLICATIONS

This application claims priority to Brazilian Patent Application No. BR 10 2014 025812 4, filed on Oct. 16, 2014, and International Patent Application No. PCT/EP2015/073960, filed on Oct. 16, 2015, both of which are hereby incorporated by reference in their entirety.

TECHNICAL FIELD

The present invention relates to a component of an internal combustion engine, and in particular a cylinder liner of the wet type provided with a circumferential outer surface which receives application of a first layer containing silicon, on which there is applied a second elastomer layer containing nanoparticles of silicon oxide, such as to increase the durability of the liner when it is working against the action of erosion by cavitation.

BACKGROUND

Cylinder liners for diesel internal combustion engines for heavy or large-sized vehicles generally have outer surfaces which are surrounded by a cooling fluid or coolant liquid which acts so as to dissipate the heat generated. These wet cylinder liners, which are better known as wet sleeves or cylinder liners, are susceptible to a fault mechanism known as erosion by cavitation.

Cavitation is the formation of vapor bubbles in liquid mediums which originate from sudden pressure drops. The movement of the cylinders results in high speeds of vibration outside the wet cylinder liner, such that the cooling fluid, when it is accelerated, has pressure reduction below the minimum pressure point at which vaporization of the fluid occurs. Thus, local vaporization of the cooling fluid occurs, forming vapor bubbles. When the local pressure increases once more, the vapor bubbles formed in the fluid collapse. If the region of collapse of the vapor bubbles is close to the outer surface of the liner, the bubbles can give rise to erosions on the surface, thus promoting loss of material, and even rupture of the wet cylinder liner.

Under the conditions described above, the phenomenon of cavitation can occur at any part close to the outer surface of the wet cylinder liner, however two types of recurrent cavitation are observed. A first type of cavitation occurs in the region of greatest force (thrust side or anti-thrust side) of the wet cylinder liner, where impact of the piston occurs, due to the secondary movement. A second type of cavitation occurs in the fitting clearances between the cylinder liner and the engine block, where there are high rates of flow of the cooling fluid. These high rates of flow reduce the local pressure of the fluid, and are affected by small movements by the cylinder liner.

Attempts by previous technology to prevent or reduce the phenomenon of cavitation and the resulting erosion are found in the prior art, such as, for example, in the Korean document KR20070060326, which describes a cylinder liner of the wet type with increased resistance to wear and cavitation. On its outer surface, the cylinder liner receives a polymer coating layer consisting of a polymer with heat conduction properties. A heat conductor agent is added to the polymer, resulting in a heterogeneous coating, with a polymer matrix and heat conductor agents distributed along the matrix.

British document GB76954 describes a cylinder liner of the wet type which receives on its outer surface a natural or synthetic rubber coating, which can be sprayed, vulcanized or set on the surface.

Both the documents described, as well as other techniques encountered, do not provide efficient solutions for the problem of erosion by cavitation and possible rupture of the cylinder liners of the wet type.

It is therefore necessary to find a solution for cylinder liners of the wet type which can guarantee excellent durability when they are subjected to the occurrence of erosion by cavitation, such that the cylinder liner sustains lesser loss of mass, thus preventing the possible rupture of the liner.

SUMMARY

The objective of the present invention consists of providing a wet cylinder liner with an outer surface which is resistant to cavitation.

The objective of the present invention also consists of providing a wet cylinder liner which comprises a first layer consisting for example of a silicon, and a second, silane-elastomer layer containing nanoparticles of silicon oxide, such as to increase the resistance of the outer surface of the liner under the action of erosion caused by cavitation.

The objective of the present invention also consists of providing a process for application of coating layers on a wet cylinder liner, so as to increase the resistance to cavitation.

The subject of the present invention is a wet cylinder liner for internal combustion engines, comprising a cylindrical body made of a ferrous alloy provided with a circumferential outer surface on which there are applied, sequentially, a first layer and a second layer, the second layer acting as an interface between a cooling fluid and the first layer deposited on the outer surface, the cylinder liner comprising the first layer consists of at least one silicon or at least one two-component epoxy adhesive, and the second layer comprises a silane-elastomer compound containing nanoparticles of silicon oxide and an adhesion modifier additive, the second layer being subject to erosion by cavitation and the first layer optionally acting as an interface for resistance at high temperatures.

The subject of the present invention is also a process for obtaining a wet cylinder liner for internal combustion engines comprising the steps of:

step i) of casting by centrifuging and polishing;

step ii) of blasting of the surface on which the first layer will be deposited;

step iii) of spraying or painting a first layer on the outer surface, the first layer being composed of a silicon, the liner being maintained at ambient temperature for at least 30 minutes; or spraying of a first layer being composed of a two-component epoxy adhesive, the cylinder being maintained at ambient temperature for at least 24 hours; and step iv) of spraying or painting of a second layer on the first layer, comprising a silane-elastomer compound containing nanoparticles of silicon oxide and an adhesion modifier additive, the liner being maintained at ambient temperature for at least 24 hours, or maintained at a temperature of 115° C. for at least 30 minutes.

The subject of the present invention is also an internal combustion engine comprising at least one wet cylinder liner as previously defined.

BRIEF DESCRIPTION OF THE DRAWINGS

The wet cylinder liner for internal combustion engines can be better understood from the following detailed description which is based on the figures listed below.

DETAILED DESCRIPTION

The present invention relates to a wet cylinder liner 10 for internal combustion engines. More particularly, the present invention concerns a cylinder liner 10 provided with a circumferential outer surface 12 on which there is applied a coating consisting of two layers. This coating comprises a first layer 1 containing silicon, applied directly on the outer surface 12 of the liner 10, and a second, silane-elastomer layer 2 containing nanoparticles of silicon oxide applied on the first layer 1. As a result, the liner 10 has greater resistance to cavitation, thus reducing the erosion of the outer surface 12, which provides lesser loss of mass of the liner 10, and consequently greater durability.

In order to understand the present invention correctly, it is necessary to explain the action of the fault mechanism known as erosion by cavitation. Firstly, the phenomenon of cavitation occurs only in fluid or liquid mediums, caused by the variation of pressures according to the workloads. Thus, the wet cylinder liner 10 is subject to the action of cavitation since its outer surface 12 is surrounded by a cooling fluid.

When the internal combustion engine is operating, pressure variations occur inside the cylinders, meaning that the cooling fluid passes through low-pressure areas and high-pressure areas. When the low pressure of the cooling fluid drops below the minimum pressure point, vaporization of the fluid occurs, and consequent formation of vapor bubbles. When they pass through a high pressure area, the vapor bubbles collapse rapidly around the outer surface 12 of the liner. This formation and collapse of vapor bubbles occurs frequently, and results in the erosion of the liner 10, generating a loss of mass, and therefore reducing the durability of the liner. The collapse of these vapor bubbles can even perforate the outer surface of the liner, leading to rupture of the liner 10.

Figure 1:
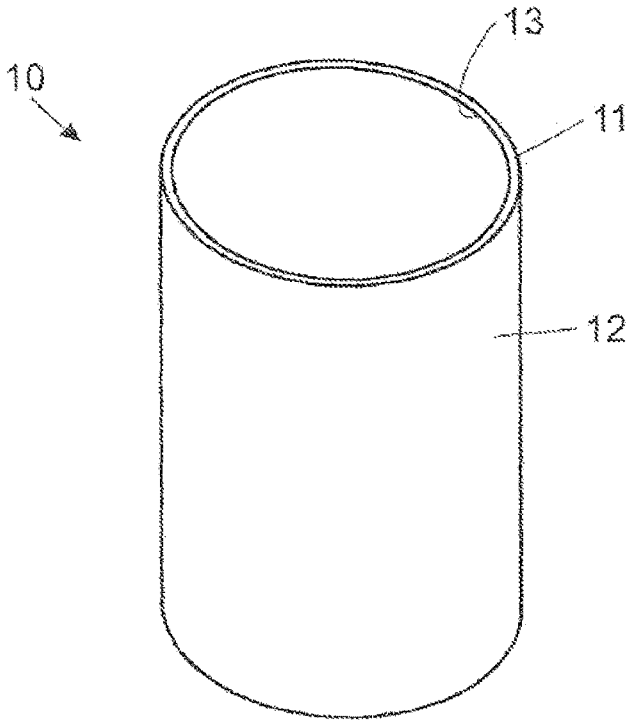
FIG. 1—view in perspective of a cylinder liner.

As shown in FIG. 1, the wet cylinder liner 10 is provided with a tube or hollow cylindrical body 11, generally constituted by a ferrous alloy such as cast iron. This cylindrical body 11 comprises two surfaces in particular, i.e. an inner surface 13 where the axial movement of a piston takes place, and a circumferential outer surface 12. The outer surface 12 is surrounded by a cooling fluid or coolant liquid and receives the application of a coating, thus configuring the present invention.

Figure 2:
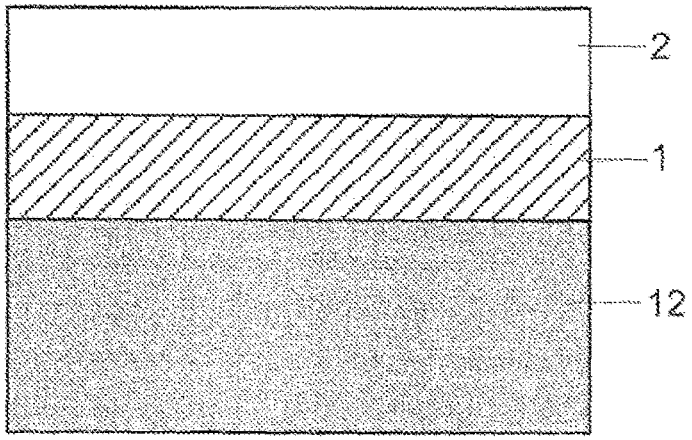
FIG. 2—diagram of the transverse cross-section of the structure of layers applied on the cylinder liner according to the present invention.

As can be observed in FIG. 2, the coating according to the present invention comprises two layers, i.e. a first polymer layer 1 containing silicon, applied directly on the outer surface 12 of the liner 10, and a second silane-elastomer layer 2 containing nanoparticles of silicon oxide and an adhesion modifier additive which is applied on the first layer 1.

The composition of the first layer 1 is preferably silicon, and optionally a two-component epoxy can be used with the addition of copper particles, such as to increase the resistance to high temperatures.

The silicon used in the first layer 1 is applied by means of a process of spraying or painting with a pressure gun, and maintaining the layer at ambient temperature for at least 30 minutes so that the first layer 1 can adhere to the outer surface 12. In an optional configuration, the two-component epoxy will be sprayed on the outer surface of the liner, and will be kept at ambient temperature for at least 24 hours.

More specifically, the second layer 2 comprises a reinforced silane-elastomer compound of the polydimethylsiloxane, with a concentration of 8% to 22% by volume of silicon oxide nanoparticles, preferably 16% to 22% by volume of silicon oxide nanoparticles, and a concentration of 8% to 9% by volume of adhesion modifier additive, of the vinylsilane and epoxysilane or aminosilane type.

The silicon oxide nanoparticles have a size of 10 nm to 800 nm, and preferably a size of 300 to 600 nm. The second layer 2 is sprayed on the first layer 1, and the liner 10 is kept at ambient temperature for at least 24 hours, and can also be subjected to an accelerated process by heating it to 115° C. for at least 30 minutes.

The layers 1, 2 have a total thickness of 50 to 500 μm, and preferably a thickness of between 50 and 300 μm, whereas the first layer 1 has a thickness of between 5 and 50 μm.

A process for obtaining a wet cylinder liner 10 for internal combustion engines, comprising the steps of:

step i) of casting by centrifuging and polishing;

step ii) of blasting of the surface on which the first layer 1 will be deposited;

step iii) of spraying or painting a first layer 1 on the outer surface 12, the first layer 1 being composed of a silicon, the liner 10 being maintained at ambient temperature for at least 30 minutes; or spraying of a first layer 1 being composed of a two-component epoxy adhesive, the liner 10 being maintained at ambient temperature for at least 24 hours; and step iv) of spraying or painting of a second layer 2 on the first layer 1, comprising a silane-elastomer compound containing nanoparticles of silicon oxide and an adhesion modifier additive, the liner 10 being maintained at ambient temperature for at least 24 hours, or maintained at a temperature of 115° C. for at least 30 minutes.

The process of application of the layers 1, 2 can be put into effect on all, i.e. 100%, of the outer surface area 12 of the liner 10, or it can be applied partially, on 50%, of the outer surface area 12 of the liner 10.

Figure 3:
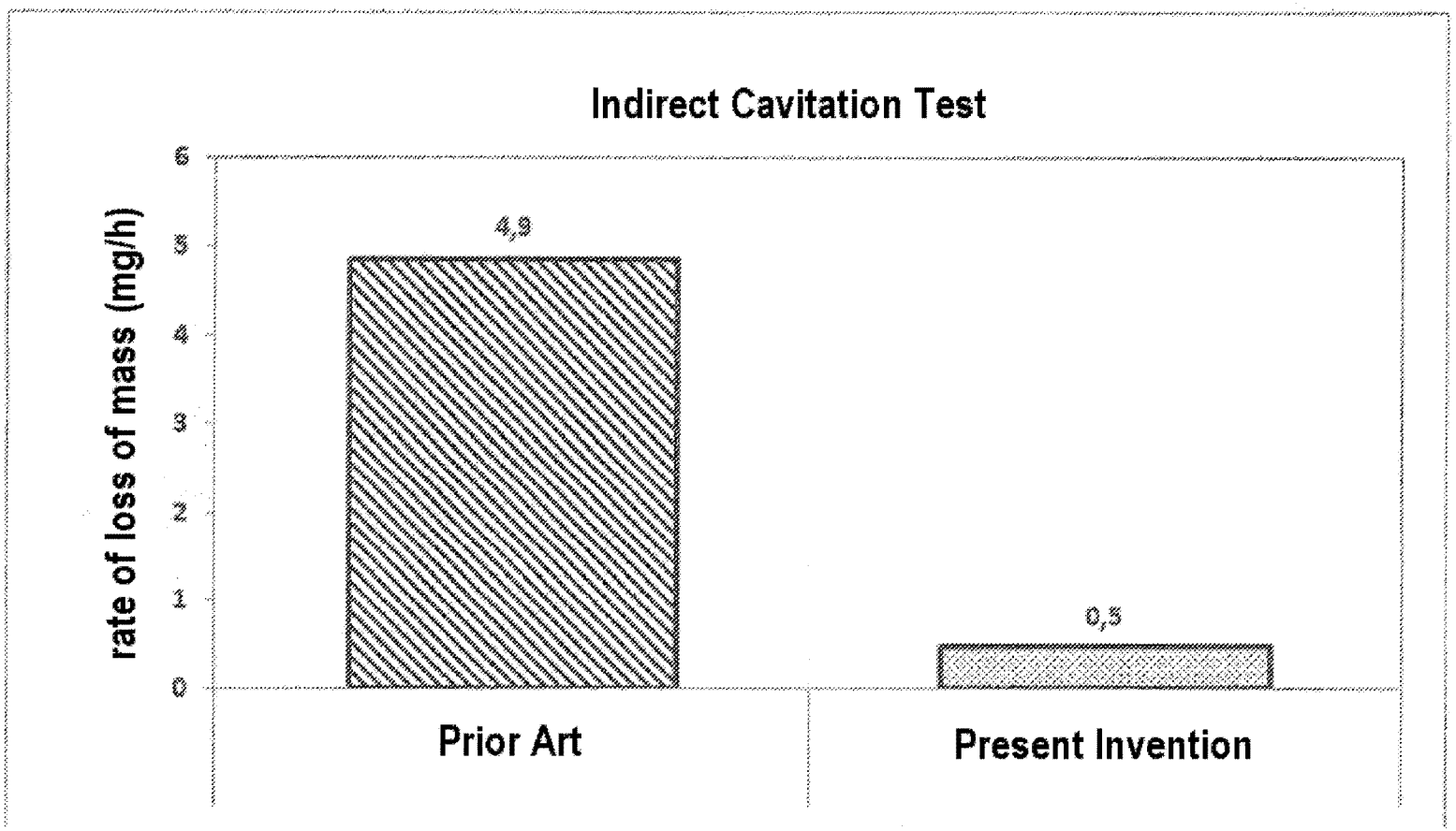
FIG. 3—resistance to loss of mass for cylinder liners in an indirect cavitation test.

The subject of the present invention has a clear advantage in comparison with the prior art, as proved by the results shown in FIG. 3 of tests carried out on test benches.

As can be analyzed in FIG. 3, rates of loss of mass are shown in mg/h (milligrams per hour) for wet cylinder liners, wherein the liner 10 according to the prior art comprises perlitic cast iron.

The tests for evaluation of the loss of mass of the wet cylinder liners were carried out in accordance with standard ASTM G32, comprising a cavitation test on test benches.

The liner 10 according to the prior art has a rate of loss of mass of 4.9 mg/h. It can also be observed that the liner according to the present invention has a rate of loss of mass of 0.5 mg/h.

As can be noted, the cylinder liner 10 according to the present invention has an average of 85% to 90% less loss of mass than the liner 10 according to the prior art. Thus, the cylinder liner 10 according to the present invention achieves a significant reduction of the rates of loss of mass compared with the solutions provided in the prior art.

This reduction of the rate of loss of mass proves that the silane-elastomer coating in two layers proposed by the present invention guarantees that the cylinder liner 10 has greater resistance, thus preventing the wet cylinder liners from sustaining damage or ruptures caused by the action of erosion by cavitation.

Having described examples of preferred embodiments, it must be understood that the scope of the present invention covers other possible variations, and that the invention is limited only by the content of the appended claims, including the possible equivalents.

The invention claimed is:

1. A wet cylinder liner for an internal combustion engine, comprising: a cylindrical body composed of a ferrous alloy having a circumferential outer surface, a first layer and a second layer disposed sequentially on the outer surface, the second layer configured as an interface between a cooling fluid and the first layer, wherein the first layer is composed of a material including at least one of at least one silicon and at least one two-component epoxy adhesive, and the second layer includes a silane-elastomer compound containing nanoparticles of silicon oxide and an adhesion modifier additive, and wherein the second layer is further configured to resist erosion by cavitation and the first layer facilitates an interface for resistance at high temperatures.

2. The cylinder liner as claimed in claim 1, wherein the silane-elastomer compound of the second layer is of a polydimethylsiloxane type.

3. The cylinder liner as claimed in claim 1, wherein the adhesion modifier additive includes at least one of a vinylsilane type, epoxysilane type and aminosilane type.

4. The cylinder liner as claimed in claim 1, wherein the second layer includes 8% to 22% by volume of silicon oxide nanoparticles.

5. The cylinder liner as claimed in claim 1, wherein the second layer includes 8% to 9% by volume of adhesion modifier additive.

6. The cylinder liner as claimed in claim 1, wherein the silicon oxide nanoparticles have a size of 10 nm to 800 nm.

7. The cylinder liner as claimed in claim 1, wherein the first layer and the second layer have a total thickness of 50 μm to 500 μm.

8. The cylinder liner as claimed in claim 1, wherein the first layer has a thickness between 5 μm and 50 μm.

9. The cylinder liner as claimed in claim 1, wherein the first layer is disposed on the outer surface via one of a spraying process and a painting process.

10. The cylinder liner as claimed in claim 1, wherein the second layer is disposed on an outer surface of the first layer via one of a spraying process and a painting process.

11. A process for producing a wet cylinder liner for an internal combustion engine, comprising: casting a cylindrical body having a circumferential outer surface via centrifugal casting centrifuging and polishing the cylindrical body; blasting the outer surface to be coated; depositing a first layer onto the outer surface, wherein depositing the first layer includes one of: applying a silicon layer via at least one of spraying and painting and maintaining the cylindrical body at ambient temperature for at least 30 minutes;

and applying a two-component epoxy adhesive via spraying and maintaining the cylindrical body at ambient temperature for at least 24 hours; and applying a second layer onto the first layer via at least one of a spraying process and a painting process, the second layer including a silane-elastomer compound containing nanoparticles of silicon oxide and an adhesion modifier additive, and maintaining the liner at one of ambient temperature for at least 24 hours and a temperature of 115° C. for at least 30 minutes.

12. The process as claimed in claim 11, wherein the first layer and the second layer cover at least 50% of a surface area of the outer surface.

13. An internal combustion engine, comprising: at least one wet cylinder liner as claimed in claim 1.

14. The internal combustion engine as claimed in claim 13, wherein the second layer includes said silicon oxide nanoparticles in a range of 8% to 22% by volume.

15. The internal combustion engine as claimed in claim 13, wherein the second layer includes the adhesion modifier additive in a range of 8% to 9% by volume.

16. The internal combustion engine as claimed in claim 15, wherein the adhesion modifier additive is at least one of a vinylsilane type, epoxysilane type and aminosilane type.

17. The internal combustion engine as claimed in claim 13, wherein the silicone oxide nanoparticles have a size ranging from 10 nm to 800 nm.

18. The cylinder liner as claimed in claim 1, wherein the second layer includes between 16% and 22% silicon oxide nanoparticles by volume.

19. The cylinder liner as claimed in claim 1, wherein the silicon oxide nanoparticles have a size of between 300 nm and 600 nm.

20. The cylinder liner as claimed in claim 1, wherein the first layer and the second layer have a total thickness between 150 μm and 300 μm.

* * * * *